US006286770B1

(12) United States Patent
Boaro et al.

(10) Patent No.: US 6,286,770 B1
(45) Date of Patent: Sep. 11, 2001

(54) FUEL INJECTION OF AN IMPROVED TYPE

(75) Inventors: Maurizio Boaro, Castenaso; Marcello Cristiani, Imola; Massimo Neretti, San Lazzaro Di Savena, all of (IT)

(73) Assignee: Magneti Marelli S.p.A., Milan (IT)

( * ) Notice: Subject to any disclaimer, the term of this patent is extended or adjusted under 35 U.S.C. 154(b) by 0 days.

(21) Appl. No.: 09/670,409

(22) Filed: Sep. 26, 2000

(30) Foreign Application Priority Data

Sep. 28, 1999 (IT) ..... B099A0520

(51) Int. Cl.[7] ..... B05B 1/30

(52) U.S. Cl. ..... 239/585.1; 239/585.3; 251/129.21; 251/210

(58) Field of Search ..... 239/585.1, 585.2, 239/585.3, 585.4, 583, 584, 541; 251/129.21, 210

(56) References Cited

U.S. PATENT DOCUMENTS 2,525,796 * 10/1950 Harding ..... 251/210
3,567,135 3/1971 Gebert .
5,636,827 6/1997 Kilgore et al. .
5,823,446 10/1998 Bennett et al. .
6,095,186 * 8/2000 Nagel ..... 251/210

FOREIGN PATENT DOCUMENTS 475 475 7/1969 (CH) .
0683315 11/1995 (EP) .

* cited by examiner

*Primary Examiner*—Lisa Ann Douglas
(74) *Attorney, Agent, or Firm*—Baker & Daniels

(57) ABSTRACT

Fuel injector, comprising a main tubular body, provided with at least one through pipe which ends in a spray nozzle which can spray the fuel present inside the through pipe, and a shutter unit, which is mobile axially inside the through pipe, from and towards a position of closure, in which the shutter unit itself abuts a sealing surface provided on the spray nozzle, and seals it in a fluid-tight manner; the shutter unit being made of a cup-type body, the base of which is defined by a sealing disc made of flexible material, on which there are provided an annular sealing projection and an annular stop projection, which is co-axial relative to the former; the annular stop projection having a height which is lower than the annular sealing projection, such as to abut the sealing surface of the spray nozzle only temporarily, subject to resilient deformation of the sealing disc itself.

6 Claims, 3 Drawing Sheets

FUEL INJECTION OF AN IMPROVED TYPE

The present invention relates to a fuel injector of an improved type.

In particular, the present invention relates to a fuel injector for internal-combustion engines, to which the following description specifically refers, without detracting from generality.

BACKGROUND OF THE INVENTION

As is known, the fuel injectors for internal-combustion engines which are commercially available at present comprise: a main tubular body, which is provided with a central through pipe, which ends at an axial end of the tubular body, in a spray nozzle, which can project outside the injector a jet of finely sprayed fuel; a shutter unit, which is fitted such as to be axially mobile inside the central pipe, from and towards the position of closure, in which it closes the spray nozzle, such as to prevent discharge of the fuel; and a contrast spring which can maintain the shutter unit in the said position of closure.

Outside the main tubular body, the fuel injectors additionally comprise a coil made of electrically conductive material, which, when an electric current is passed through it, can generate a magnetic field which can overcome the resilient force of the spring, such as to move the shutter unit away temporarily from the position of closure, so as to permit controlled discharge of the fuel.

The shutter unit is obviously made at least partially of ferro-magnetic material, and in some types of injector, it consists of a cup-type body with a cylindrical shape, which is fitted such as to be mobile axially inside the central pipe, with its own base facing towards the spray nozzle, such that in the position of closure, it is disposed with its base abutting a flat surface provided on the spray nozzle.

Owing to the strong mechanical stresses to which it is subjected, the shutter unit, i.e. the cup-type body with a cylindrical shape, normally consists of a cylindrical tubular element made of ferro-magnetic material, and of a highly-resistant sealing disc made of rigid material, which is welded to an axial end of the said cylindrical tubular element. This disc has a considerable thickness, and is provided on its outer flat surface with two concentric annular projections which have the same height, and can provide the hydraulic sealing when they abut the flat surface which delimits the spray nozzle. Finally, in order to permit passage of the fuel, the sealing disc is provided with a plurality of through holes, which can put the interior of the cup-type body into communication with the outer flat surface of the disc, at the area delimited by the two concentric circular projections.

The main disadvantage of the above-described fuel injectors is that in the final part of their vital cycle, they are subject at intervals to undesirable blow-by of fuel, with a substantial increase in the pollutant emissions, which does not enable the internal-combustion engine to comply with the directives concerning pollutant emission.

In fact, in the long term, the repeated impacts of the shutter unit on the flat surface which delimits the spray nozzle give rise to localised resilient deformations, which in some cases do not allow the shutter disc, or rather its two concentric annular projections, to be placed so as to abut correctly the flat surface which delimits the spray nozzle, so as to provide the hydraulic sealing, and thus prevent discharge of the fuel from the spray nozzle.

SUMMARY OF THE INVENTION

The object of the present invention is to provide a fuel injector for internal-combustion engines, which is free from the above-described disadvantages.

According to the present invention, a fuel injector of an improved type is provided, which comprises a main tubular body, provided with at least one through pipe which ends in a spray nozzle which can spray to the exterior the fuel which is present inside the through pipe, and a shutter unit which is mobile inside the said through pipe, from and towards a position of closure, in which it abuts the spray nozzle, shutting the latter such as to prevent discharge of the fuel; the spray nozzle being provided with a sealing surface against which the shutter unit can abut, and the shutter unit being shaped substantially in the form of a cup, such that, in the position of closure, its own base abuts the said sealing surface, in order to prevent the fuel from being discharged; the said fuel injector being characterised in that the base of the said shutter unit is provided with a sealing projection, which can abut the sealing surface of the spray nozzle, in order to form the hydraulic seal, and a stop projection, which can temporarily abut the said sealing surface in order to stop the path of the shutter element itself; the sealing projection having a height which is greater than the height of the stop projection, and the base of the said shutter unit being resiliently deformable, so as to permit impact in succession of the said sealing projection and the said stop projection.

BRIEF DESCRIPTION OF THE DRAWINGS

The present invention will now be described with reference to the attached drawings, which illustrate a non-limiting embodiment of it, in which:

FIG. 2 illustrates on an enlarged scale a detail of the fuel injector illustrated in FIG. 1; whereas

DETAILED DESCRIPTION OF THE INVENTION

Figure 1:
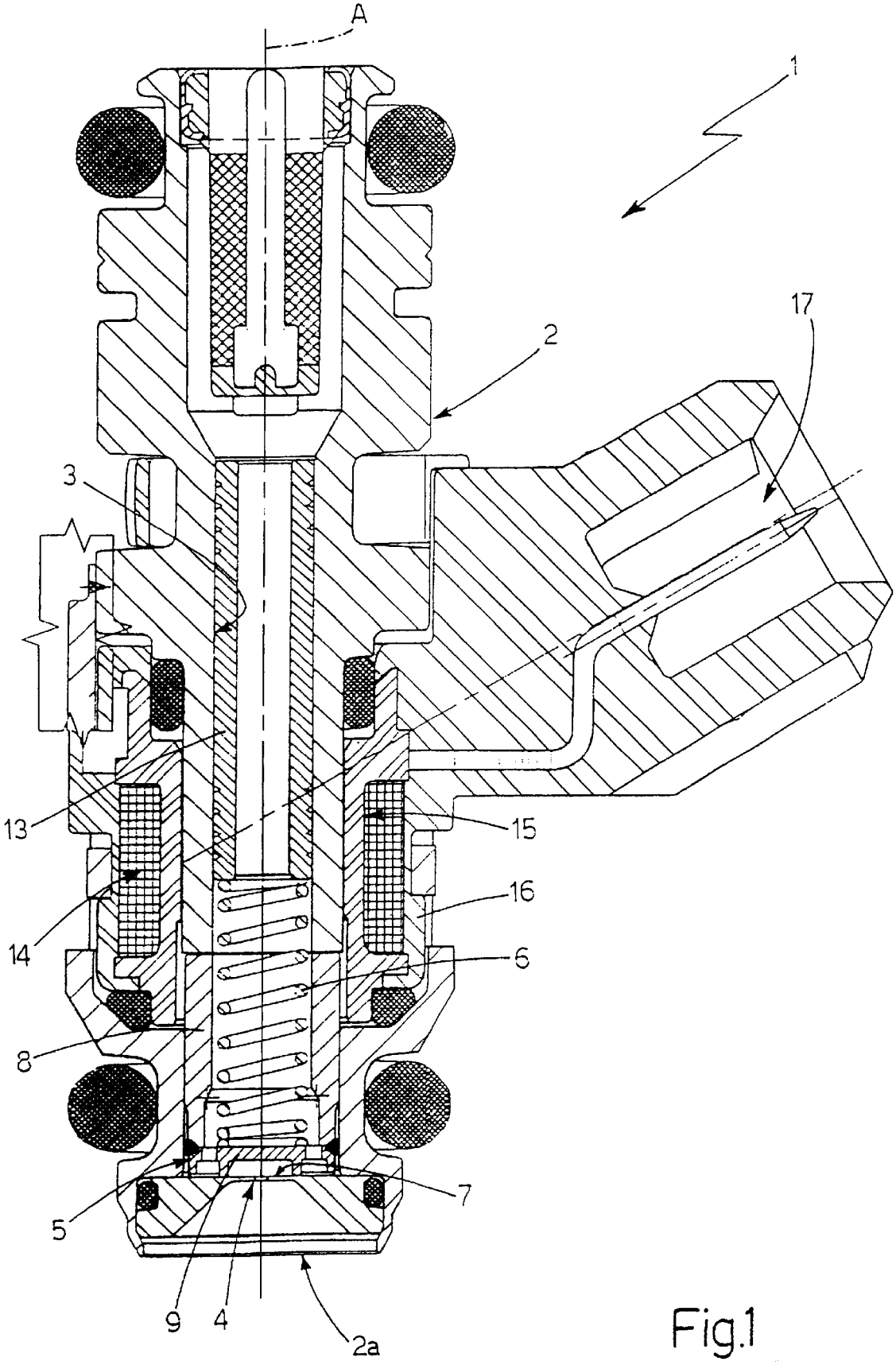
FIG. 1 is a view in cross-section of a fuel injector produced according to the dictates of the present invention.

With reference to FIG. 1, the number 1 indicates as a whole a fuel injector, which is particularly suitable for being fitted on internal-combustion engines of a known type.

The injector 1 comprises a main tubular body 2, which is provided with a through pipe 3 with a variable diameter, into which pressurised fuel is supplied. This through pipe 3 extends co-axially relative to the longitudinal axis A of the tubular body 2, and ends at an axial end 2*a* of the tubular body 2, in a spray nozzle 4, which can project a finely sprayed jet of fuel outside the injector 1 itself.

The injector 1 additionally comprises a shutter unit 5, which is mounted so as to be mobile axially inside an end portion of the through pipe 3, from and towards a position of closure, in which the shutter unit 5 itself obstructs the spray nozzle 4, such as to prevent discharge of the fuel, and a contrast spring 6, which can keep the shutter unit 5 in the said position of closure.

In particular, the shutter unit 5 consists of a cup-type body which is preferably, but not necessarily, cylindrical, and is fitted such as to slide axially inside the pipe 3, with its own end facing the spray nozzle 4, such that, when it is in the position of closure, it can be placed with its base abutting a sealing surface 7 provided on the spray nozzle 4 itself, in order to provide the hydraulic seal. This sealing surface 7 is preferably, but not necessarily, flat.

Figure 2:
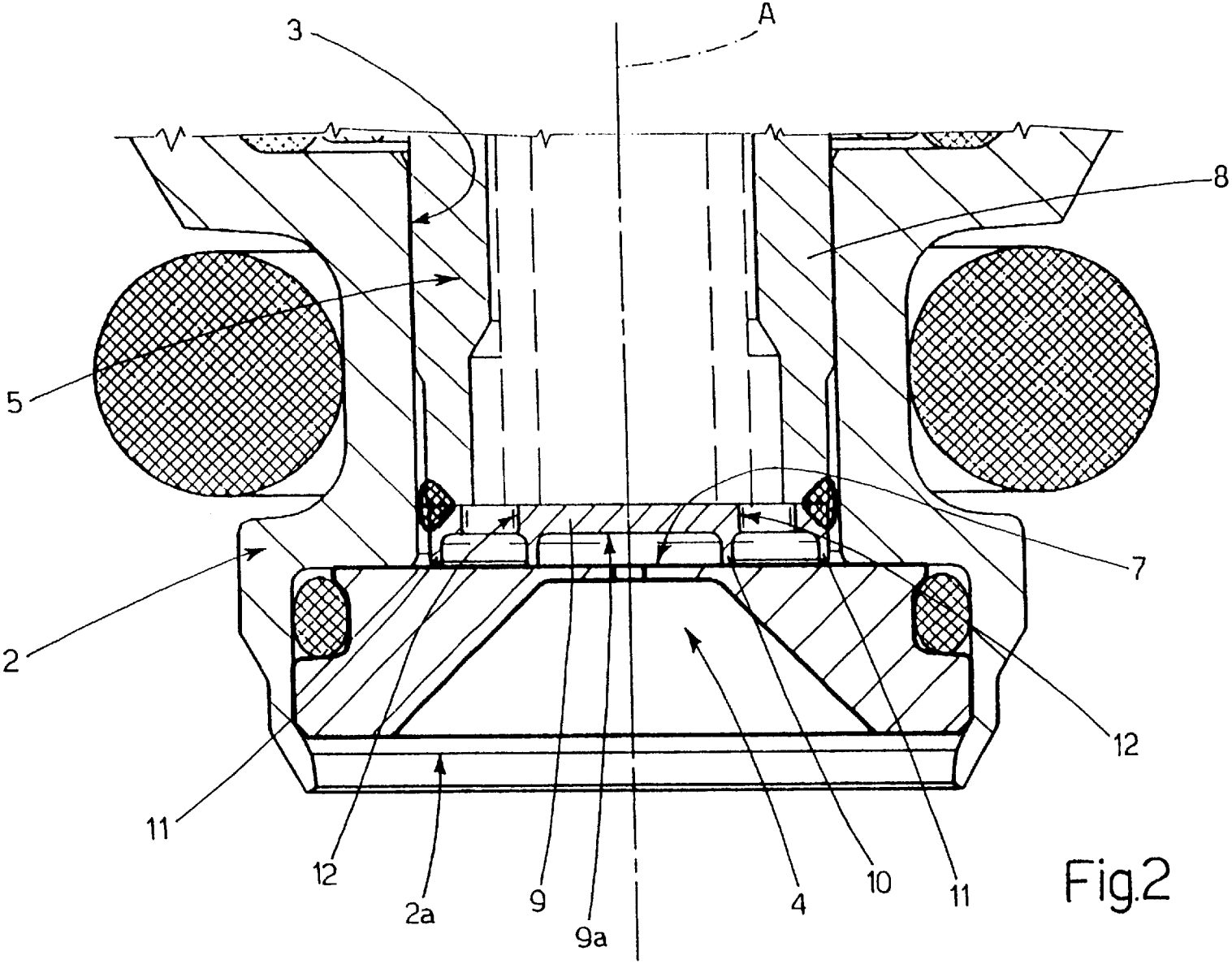

With reference to FIGS. 1 and 2, in the example illustrated the tubular body consists of three tubular elements, which are connected mechanically to one another, whereas the spray nozzle 4 consists of a disc with a calibrated central hole, which is fitted onto an axial end 2*a* of the tubular body 2, such as to be perpendicular to the longitudinal axis A of the tubular body 2 itself. The surface of the disc which faces through pipe 3 defines the sealing surface 7, whereas in the example illustrated, the surface of the disc which faces in the direction opposite the through pipe 3 has a frusto-conical flare which serves the purpose of guaranteeing improved spraying and diffusion of the jet of fuel.

With reference to FIGS. 1 and 2, the cup-type body which defines the shutter unit 5 on the other hand consists of a cylindrical tubular element 8 made of ferro-magnetic material, and a sealing disc 9 made of highly-resistant flexible material, which is welded onto an axial end of the cylindrical tubular element 8, such as to define the base of the cup-type body.

The sealing disc 9 has a thickness which is substantially smaller than discs with similar functions which are in use at present, such as to be flexible, and has, on its own outer flat surface 9*a,* i.e. on the surface which does not face the cylindrical tubular element 8, two concentric annular projections, which are co-axial relative to the axis A. The inner annular projection, which is indicated hereinafter by the number 10, extends without solution of continuity, has a specific height h', and can abut the spray nozzle 4, i.e. the sealing surface 7, such as to surround the calibrated central hole, so as to form the hydraulic seal. On the other hand the outer circular projection, which is indicated hereinafter by the number 11, extends preferably, but not necessarily, with solution of continuity (i.e. it is broken up into several segments), has a height h" which is lower than the height h' of the inner circular projection 10, and can temporarily abut the spray nozzle 4, in order to stop the path of the shutter unit 5, as will be described in greater detail hereinafter.

Finally, the sealing disc 9 has a plurality of through holes 12, which can permit passage of the fuel from the interior of the cup-type body, i.e. the interior of the shutter unit 5, towards the outer flat surface 9*a* of the disc, at the area delimited by the two annular projections 10 and 11.

The contrast spring 6 is disposed inside the pipe 3, co-axially relative to the axis A, with a first end abutting the base of the shutter unit 5, i.e. the sealing disc 9, and a second end abutting a shoulder provided inside the pipe 3.

In the example illustrated, this shoulder is defined by the axial end of a spring-thrust body 13 inserted inside the pipe 3, immediately upstream from the section of the through pipe 3 in which the shutter unit 5 is mobile. This spring-thrust body 13 constitutes an integral part of the tubular body 2, has a cylindrical tubular shape, and is made preferably, but not necessarily, of ferro-magnetic material. The position of the spring-thrust body 13 inside the pipe 3 can be adjusted during fitting of the injector 1, such as to regulate the compression of the contrast spring 6.

Finally, the injector 1 comprises a coil 14 made of electrically conductive material, fitted onto the tubular body 2, inside an outer annular seat 15 provided on the tubular body 2, and an outer protective housing 16, which in turn is fitted onto the coil 14, such as to enclose the coil 14 on the tubular body 2. When electric current is passed through it, the coil 14 can generate a magnetic field which can overcome the resilient force of the contrast spring 6, and move the shutter unit 5 axially, such as to displace it from the position of closure.

In the example illustrated, on the outer housing 16, there is provided an electrical connector 17, by means of which it is possible to convey the electric current to the coil 14.

Figure 3:
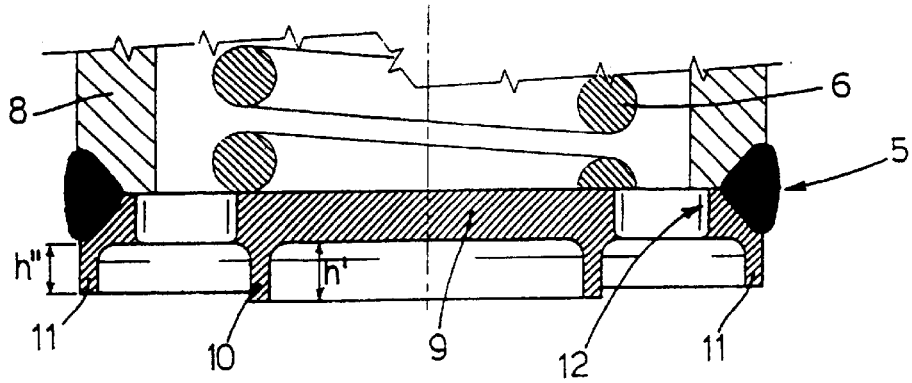
FIGS. 3 to 6 illustrate a detail of the detail illustrated in FIG. 2, in respective operating positions.
Figure 4:
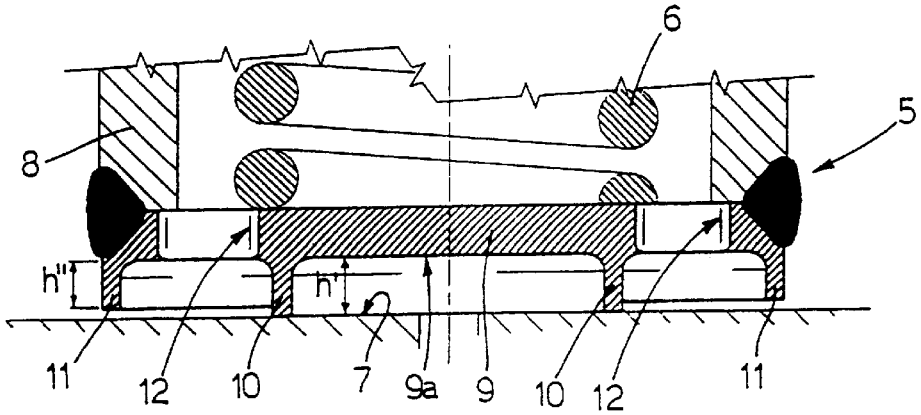
Figure 5:
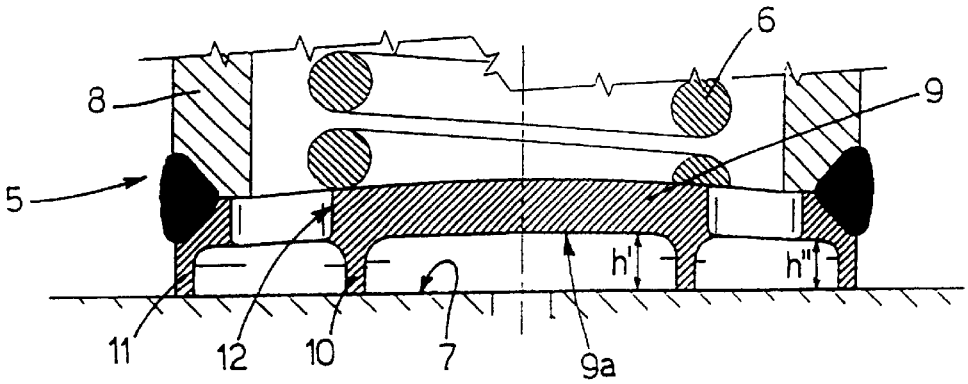

The functioning of the fuel injector 1 will be described with reference to FIGS. 3 to 5, on the assumption that the shutter unit 5 is initially in the opening position, i.e. with the outer flat surface 9*a* of the sealing disc 9 at a specific distance from the spray nozzle 4, i.e. from the sealing surface 7, such as to allow discharge of the pressurised fuel via the spray nozzle 4.

As soon as the magnetic field generated by the coil 14 disappears, the contrast spring 6 thrusts the shutter unit 5 with force against the sealing surface 7 of the spray nozzle 4. When the inner annular projection 10 comes into contact with the sealing surface 7 (see FIG. 4), the sealing disc 9 is deformed resiliently, until the outer annular projection 11 is also brought into contact with the sealing surface 7 (see FIG. 5).

Figure 6:
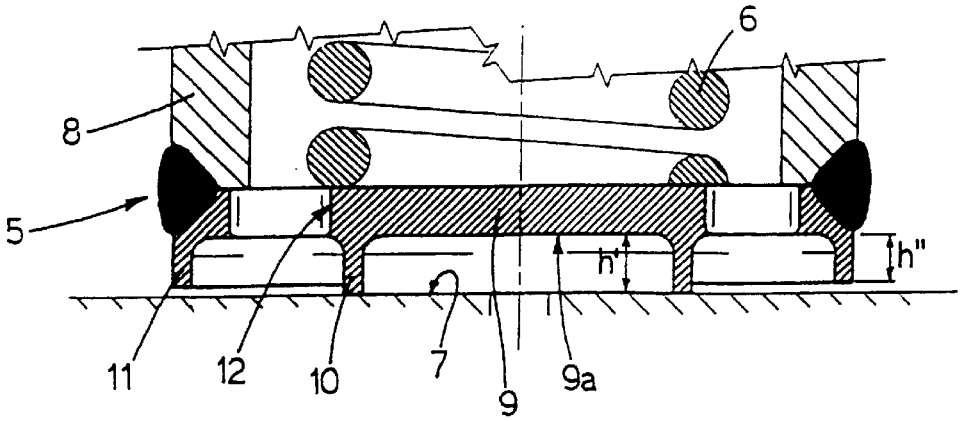

The deformation of the sealing disc 9 dissipates almost entirely the kinetic energy of the shutter body 5, thus allowing the outer annular projection 11 to strike the sealing surface 7, in order to stop the path of the shutter unit 5 at a relatively low speed, such as to preclude any possibility of rebound of the shutter unit 5 itself. Subsequently, the sealing disc 9 returns to the original position (see FIG. 6), leaving only the inner annular projection 10 abutting the sealing surface 7, in order to form the hydraulic seal.

Substantially therefore, the shutter unit 5 differentiates the points at which the hydraulic seal is formed, from the points at which it abuts the sealing surface 7 in order to stop its own path.

The advantages of the fuel injector 1 described and illustrated above are apparent: firstly, since the sealing disc 9 can absorb the kinetic energy of the shutter unit 5, it reduced substantially the mechanical stresses to which the sealing surface 7 of the spray nozzle 4 is subjected, thus increasing the average service life of the device. Secondly, the flexibility of the sealing disc 9, combined with the fact that the hydraulic seal is provided only by means of the inner annular projection 10, allows the shutter unit 5 to adapt in the best possible way also to sealing surfaces 7 which are slightly deformed, thus eliminating the risks of undesirable blow-by of fuel.

A further advantage of the fuel injector 1 described and illustrated above, consists of having a shutter unit 5 which is lighter than those which are in use at present, thus permitting an increase in performance, and simultaneous reduction of the production costs.

Finally, it is apparent that modifications and variants can be made to the injector 1 described and illustrated here, without departing from the context of the present invention.

What is claimed is:

1. Fuel injector (1), of an improved type, comprising a main tubular body (2), provided with at least one through pipe (3) which ends in a spray nozzle (4) which can spray to the fuel which is present inside the through pipe (3), and a shutter unit (5), which is mobile inside the said through pipe (3), from and towards a position of closure, in which it abuts the spray nozzle (4), shutting the spray nozzle, such as to prevent discharge of the fuel; the spray nozzle (4) being provided with a sealing surface (7), against which the shutter unit (5) can abut, and the shutter unit (5) being shaped substantially in the form of a cup, such that, in the position of closure, its own base (9) abuts the said sealing surface (7), in order to prevent discharge of the fuel; the said fuel injector (1) being characterised in that the base (9) of the said shutter unit (5) is provided with sealing projection (10) which can abut the sealing surface (7) of the spray nozzle (4), in order to form the hydraulic seal, and a stop projection (11), which can temporarily abut the said sealing surface (7) in order to stop the path of the shutter element (5) itself; the sealing projection (10) having a height h' which is greater than the height h" of the stop projection (11), and the base (9) of the said shutter unit (5) being resiliently deformable to permit impact in succession of the said sealing projection (10) and the said stop projection (11).

2. Fuel injector according to claim 1, characterised in that the said sealing projection (10) has a substantially annular shape, and the said stop projection (11) is disposed outside the said sealing projection (10).

3. Fuel injector according to claim 2, characterised in that the said shutter unit (5) comprises a cylindrical tubular element (8) made of ferro-magnetic material, which is mobile axially inside the through pipe, and a sealing disc (9) made of flexible material, which is secured to an axial end of the cylindrical tubular element (8) which faces the spray nozzle (4); the said sealing disc (9) defining the base (9) of the said shutter unit (5).

4. Fuel injector according to claim 1, characterised in that the base (9) of the said shutter unit (5) has at least one through hole (12) which can permit the passage of fuel from the interior of the shutter unit (5) towards an outer surface **(9*a*) of the base (9) of the shutter unit (5)** itself.

5. Fuel injector according to claim 4, characterised in that the said through hole (12) can put the interior of the shutter unit (5) into communication with the area of the outer surface **(9*a*) of the base (9) of the shutter unit (5), which is delimited by the said sealing projection (10) and by the said stop projection (11)**.

6. Fuel injector according to claim 1, characterised in that the said spray nozzle (4) consists of a disc with a calibrated central hole (4), which is fitted onto an axial end **(2*a*) of the tubular body (2), to be perpendicular to a longitudinal axis (A) of the tubular body (2) itself; the surface of the disc with the calibrated central hole (4) which faces the through pipe (3) defining the sealing surface (7)**.

* * * * *

UNITED STATES PATENT AND TRADEMARK OFFICE

CERTIFICATE OF CORRECTION

PATENT NO. : 6,286,770 B1
DATED : September 11, 2001
INVENTOR(S) : Boaro et al.

It is certified that error appears in the above-identified patent and that said Letters Patent is hereby corrected as shown below:

Title page,
ABSTRACT,
Line 4, after "the" insert -- said --

Column 4,
Line 53, delete "to"
Line 57, delete "such as"

Signed and Sealed this

Seventh Day of May, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,286,770 B1
DATED : September 11, 2001
INVENTOR(S) : Maurizio Boaro et al.

It is certified that error appears in the above-identified patent and that said Letters Patent is hereby corrected as shown below:

Title page,
Item [54], delete "INJECTION" and substitute therefor -- INJECTOR --

Signed and Sealed this

Third Day of December, 2002

JAMES E. ROGAN
*Director of the United States Patent and Trademark Office*